US007025601B2

(12) United States Patent
Dittmann

(10) Patent No.: US 7,025,601 B2
(45) Date of Patent: Apr. 11, 2006

(54) INTERPOSER AND METHOD FOR MAKING SAME

(75) Inventor: Larry E. Dittmann, Middletown, PA (US)

(73) Assignee: Neoconix, Inc., Sunnyvale, CA (US)

( * ) Notice: Subject to any disclaimer, the term of this patent is extended or adjusted under 35 U.S.C. 154(b) by 0 days.

(21) Appl. No.: 10/884,709

(22) Filed: Jul. 2, 2004

(65) Prior Publication Data

US 2005/0208786 A1 Sep. 22, 2005

Related U.S. Application Data

(60) Provisional application No. 60/554,820, filed on Mar. 19, 2004.

(51) Int. Cl.
*H01R 12/00* (2006.01)

(52) U.S. Cl. ..... 439/66

(58) Field of Classification Search ..... 439/65, 439/66, 67, 77, 91
See application file for complete search history.

(56) References Cited

U.S. PATENT DOCUMENTS

| | | | | |
|---|---|---|---|---|
| 3,543,587 | A | 12/1970 | Kawada | |
| 3,634,807 | A | 1/1972 | Grobe et al. | |
| 3,670,409 | A | 6/1972 | Reimer | |
| 4,548,451 | A * | 10/1985 | Benarr et al. | 439/85 |
| 4,893,172 | A | 1/1990 | Matsumoto et al. | |
| 4,998,885 | A | 3/1991 | Beaman | |
| 5,152,695 | A | 10/1992 | Grabbe et al. | |
| 5,173,055 | A | 12/1992 | Grabbe | |
| 5,199,879 | A | 4/1993 | Kohn et al. | |
| 5,228,861 | A | 7/1993 | Grabbe | |
| 5,257,950 | A | 11/1993 | Lenker et al. | |
| 5,292,558 | A | 3/1994 | Heller et al. | |
| 5,299,939 | A * | 4/1994 | Walker et al. | 439/74 |
| 5,358,411 | A | 10/1994 | Mroczkowski et al. | |
| 5,366,380 | A | 11/1994 | Reymond | |
| 5,468,655 | A | 11/1995 | Greer | |
| 5,483,741 | A | 1/1996 | Akram et al. | |
| 5,530,288 | A | 6/1996 | Stone | |
| 5,532,612 | A | 7/1996 | Liang | |

(Continued)

FOREIGN PATENT DOCUMENTS

| | | |
|---|---|---|
| EP | 0692823 | 1/1996 |

(Continued)

OTHER PUBLICATIONS

An article entitled "Patented Socketing System for the BGA/CSP Technology" by E-tec Interconnect Ltd., pp. 1-4.

(Continued)

*Primary Examiner*—Khiem Nguyen
(74) *Attorney, Agent, or Firm*—Michael Bednarek; Pillsbury Winthrop Shaw Pittman LLP

(57) ABSTRACT

An interposer and method for making same is disclosed. A metallic sheet is formed with a plurality of spring members. A first sheet of insulative material is provided on a top surface of the metallic sheet and a second sheet of insulative material is provided on a bottom surface of the metallic sheet. The insulative material sheets each include a plurality of flaps wherein each flap at least partially corresponds to a particular one of the spring members in the metallic sheet. A conductive material is located in a predefined pattern on the first and second insulative sheets having a conductive contact portion extending onto the flaps. Vias are connected to the conductive material and extend through metallic and insulative sheets to provide electrical connectivity.

7 Claims, 6 Drawing Sheets

U.S. PATENT DOCUMENTS 5,590,460 A 1/1997 DiStefano et al.
5,593,903 A 1/1997 Beckenbaugh et al.
5,629,837 A 5/1997 Barabi et al.
5,632,631 A 5/1997 Fjelstad et al.
5,772,451 A 6/1998 Dozier, II et al.
5,791,911 A 8/1998 Fasano et al.
5,802,699 A 9/1998 Fjelstad et al.
5,812,378 A 9/1998 Fjelstad et al.
5,842,273 A 12/1998 Schar
5,860,585 A 1/1999 Rutledge et al.
5,896,038 A 4/1999 Budnaitis et al.
5,934,914 A 8/1999 Fjelstad et al.
5,967,797 A 10/1999 Maldonado
5,980,335 A 11/1999 Barbieri et al.
5,989,994 A 11/1999 Khoury et al.
6,019,611 A 2/2000 McHugh et al.
6,031,282 A 2/2000 Jones et al.
6,032,356 A 3/2000 Eldridge et al.
6,042,387 A 3/2000 Jonaidi
6,063,640 A 5/2000 Mizukoshi et al.
6,083,837 A 7/2000 Millet
6,133,534 A 10/2000 Fukutomi et al.
6,146,151 A 11/2000 Li
6,156,484 A 12/2000 Bassous et al.
6,184,699 B1 2/2001 Smith et al.
6,196,852 B1 3/2001 Neumann et al.
6,200,143 B1 3/2001 Haba et al.
6,204,065 B1 3/2001 Ochiai
6,205,660 B1 3/2001 Fjelstad et al.
6,208,157 B1 3/2001 Akram et al.
6,221,750 B1 4/2001 Fjelstad
6,224,392 B1 5/2001 Fasano et al.
6,250,933 B1 6/2001 Khoury et al.
6,255,727 B1 7/2001 Khoury
6,264,477 B1 7/2001 Smith et al.
6,293,806 B1 9/2001 Yu
6,293,808 B1 9/2001 Ochiai
6,297,164 B1 10/2001 Khoury et al.
6,298,552 B1 10/2001 Li
6,306,752 B1 10/2001 DiStefano et al.
6,335,210 B1 1/2002 Farooq et al.
6,336,269 B1 1/2002 Eldridge et al.
6,337,575 B1 1/2002 Akram
6,361,328 B1 3/2002 Gosselin
6,373,267 B1 4/2002 Hiroi
6,374,487 B1 4/2002 Haba et al.
6,392,524 B1 5/2002 Biegelsen et al.
6,392,534 B1 5/2002 Flick
6,399,900 B1 6/2002 Khoury et al.
6,402,526 B1 6/2002 Schreiber et al.
6,420,661 B1 7/2002 DiStefano et al.
6,420,789 B1 7/2002 Tay et al.
6,420,884 B1 7/2002 Khoury et al.
6,428,328 B1 8/2002 Haba et al.
6,436,802 B1 8/2002 Khoury
6,437,591 B1 8/2002 Faynworth et al.
6,442,039 B1 8/2002 Schreiber
6,452,407 B1 9/2002 Khoury et al.
6,461,892 B1 10/2002 Beroz
6,472,890 B1 10/2002 Khoury et al.
6,474,997 B1 11/2002 Ochiai
6,492,251 B1 12/2002 Haba et al.
6,517,362 B1 2/2003 Hirai et al.
6,520,778 B1 2/2003 Eldridge et al.
6,524,115 B1 2/2003 Gates et al.
6,551,112 B1 4/2003 Li et al.
6,576,485 B1 6/2003 Zhou et al.
6,604,950 B1 8/2003 Maldonado et al.
6,612,861 B1 9/2003 Khoury et al.
6,616,966 B1 9/2003 Mathieu et al.
6,622,380 B1 9/2003 Grigg
6,627,092 B1 9/2003 Clements et al.
6,640,432 B1 11/2003 Mathieu et al.
6,661,247 B1 12/2003 Maruyama et al.
6,664,131 B1 12/2003 Jackson
6,671,947 B1 1/2004 Bohr
6,677,245 B1 1/2004 Zhou et al.
6,692,263 B1 * 2/2004 Villain et al. ..... 439/66
6,700,072 B1 3/2004 DiStefano et al.
6,719,569 B1 * 4/2004 Ochiai ..... 439/66
6,730,134 B1 5/2004 Neidich
6,736,665 B1 5/2004 Zhou et al.
6,750,136 B1 6/2004 Zhou et al.
6,791,171 B1 9/2004 Mok et al.
6,815,961 B1 11/2004 Mok et al.
6,847,101 B1 1/2005 Fjelstad et al.
6,848,173 B1 2/2005 Fjelstad et al.
6,857,880 B1 * 2/2005 Ohtsuki et al. ..... 439/66
2002/0011859 A1 1/2002 Smith et al.
2002/0055282 A1 5/2002 Eldridge et al.
2002/0058356 A1 5/2002 Oya
2002/0079120 A1 6/2002 Eskildsen et al.
2002/0129894 A1 9/2002 Liu et al.
2002/0133941 A1 9/2002 Akram et al.
2002/0146919 A1 10/2002 Cohn
2002/0178331 A1 11/2002 Beardsley et al.
2003/0003779 A1 * 1/2003 Rathburn ..... 439/66
2003/0035277 A1 2/2003 Saputro et al.
2003/0089936 A1 5/2003 McCormack et al.
2003/0096512 A1 5/2003 Cornell
2003/0099097 A1 5/2003 Mok et al.
2003/0129866 A1 7/2003 Romano et al.
2003/0147197 A1 8/2003 Uriu et al.
2003/0194832 A1 10/2003 Lopata et al.
2004/0118603 A1 6/2004 Chambers
2004/0127073 A1 * 7/2004 Orchiai ..... 439/66
2005/0099193 A1 5/2005 Burgess

FOREIGN PATENT DOCUMENTS

EP 1208241 1/2003
JP 200011443 4/2000
JP 2001203435 7/2001
WO WO 9602068 1/1996
WO WO 9744859 11/1997
WO WO 0213253 2/2002

OTHER PUBLICATIONS

Gary B. Kromann et al., "Motorola's PowerPC 603 and PowerPC 604 RISC Microprocessor: the C4/Cermanic-ball-grid Array Interconnect Technology," Motorola Advanced Packaging Technology, Motorola, Inc., 1996, pp. 1-10.

Ravi Mahajan et al., "Emerging Directions for packaging Technologies," Intel Technology Journal, V. 6, Issue 02, May 16, 2002, pp. 62-75.

* cited by examiner

INTERPOSER AND METHOD FOR MAKING SAME

CROSS REFERENCE TO RELATED APPLICATION(S)

This application claims priority from U.S. provisional application No. 60/554,820 filed on Mar. 19, 2004, which is incorporated by reference as if fully set forth.

FIELD OF INVENTION

The present invention relates to electrical contacts. More particularly, the present invention is directed to an interposer and a method for making an interposer.

BRIEF DESCRIPTION OF THE DRAWING(S)

The following detailed description will be better understood when read in conjunction with the following drawings, which illustrate preferred embodiments of the invention. In the drawings.

DETAILED DESCRIPTION OF THE PREFERRED EMBODIMENT(S)

Figure 1:
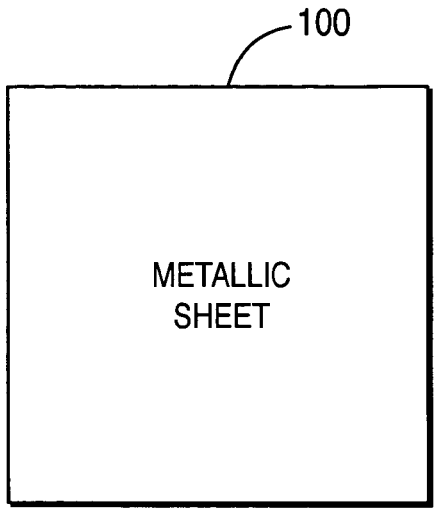
FIG. 1 is a metallic sheet in accordance with a preferred embodiment of the present invention.

Certain terminology is used in the following description for convenience only and is not limiting. The words "right," "left," "lower" and "upper" designate directions in the drawings to which reference is made. The words "inwardly," "outwardly," "upwardly," and downwardly" refer to directions toward and away from, respectively, the geometric center of the die package in accordance with the invention and designated parts thereof. The terminology includes the words above specifically mentioned, derivatives thereof and words of similar import.

The present invention will be described with reference to the drawing figures wherein like numerals represent like elements throughout.

Referring now to FIG. 1, there is shown a metallic sheet 100. The metallic sheet 100 may be made of any type of metallic material that provides the desired spring properties. In a preferred embodiment, however, the metallic sheet 100 is stainless steel. The metallic sheet may be of any shape, size, and/or thickness as desired. That is, while a square sheet 100 is shown purely by way of example, the interposer of the present invention may be utilized in a wide variety of applications between a wide variety of devices and may be adapted as appropriate depending on the application and devices and any other relevant considerations. In a preferred embodiment, the thickness of the metallic sheet 100 is approximately 0.004 inches, but may vary depending on the spring characteristics that are desired at the spring members 102 and/or the flexibility desired in the sheet 100 itself.

Figure 2:
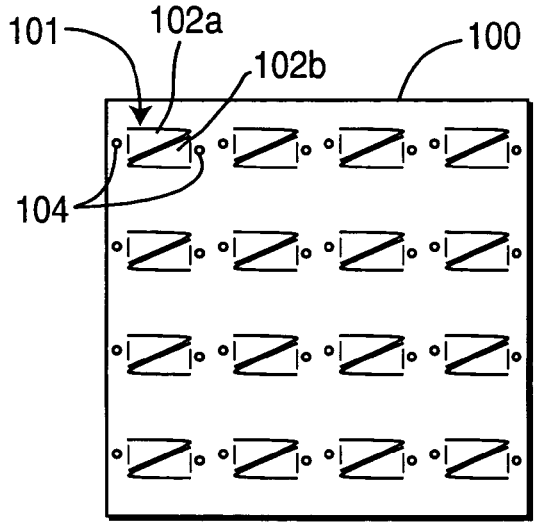
FIG. 2 is a diagram of the metallic sheet shown in FIG. 1 wherein the sheet includes a plurality of contact supports, each having spring members disposed upward and downward with respect to the sheet and at least one opening.

Referring now to FIG. 2, in a first preferred embodiment, the metallic sheet 100 is configured to include a plurality of contact supports 101 each having at least two spring members 102*a*, 102*b* and at least one clearance opening 104. While two spring members 102*a*, 102*b* per contact support 101 are shown for purposes of explaining the present invention, a contact support 101 may include any number of spring members. Similarly, while sixteen contact supports 101 are shown for purposes of explaining the present invention, the metallic sheet 100 may include any number of contact supports 101, depending on the particular application. Additionally, while two openings 104 are shown for purposes of explaining the present invention, only one is necessary to allow for electrical connectivity within a contact. For example, having two or more openings allows an extra connection to be provided between the contacts formed on the spring members 102*a*, 102*b*, described in detail below, such that if one connection fails, connectivity is maintained. Alternatively, additional openings may be included to provide multiple circuits at a single contact. Further, it is important to note that while two spring members 102*a*, 102*b* are presently preferred, in other embodiments, a single spring member may be utilized on one side wherein electrical connectivity is provided by electrically connecting the spring member to a via having a solder ball or other type of connector on the other side.

Figure 3:
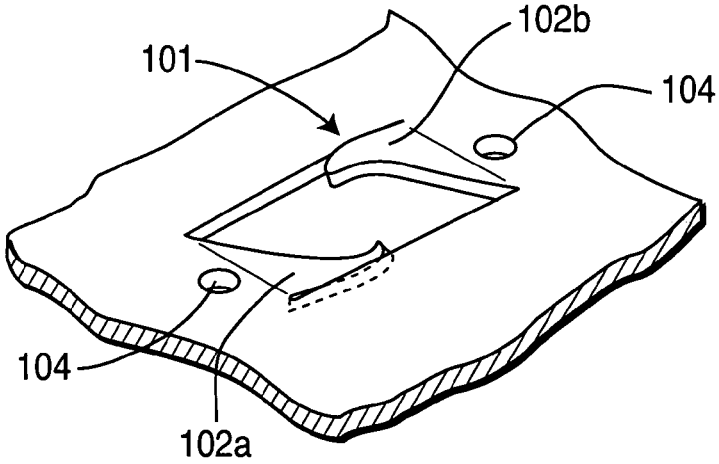
FIG. 3 is an exploded view of upward and downward spring members and openings.

The spring members 102*a*, 102*b* and opening(s) 104 may be defined on the metallic sheet 100 utilizing any process known to those skilled in the art. Purely by way of example, a chemical etching process may be used. The spring members 102*a*, 102*b* are preferably at least partially disposed downward and upward, as shown in FIG. 3, for example. In order to dispose (i.e. form) spring members 102*a*, 102*b* downward and upward, pressure is applied. Purely be way of example, pressure may be applied by punching, stamping, or any other suitable forming process.

Figure 4:
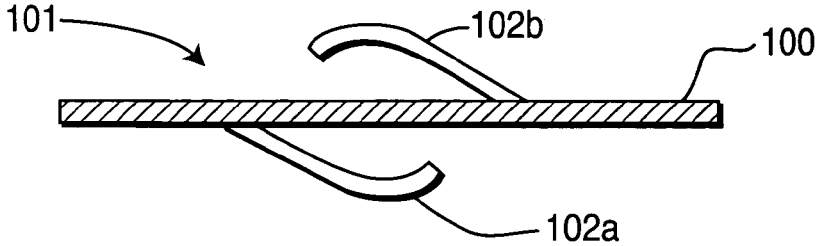
FIG. 4 is a cross-sectional view of the metallic sheet of FIG. 2 showing an upward and downward spring member of the metallic sheet.

Still referring to FIG. 3, as mentioned above, two spring members 102*a*, 102*b* and two openings 104 are, in one embodiment, provided at each contact support 101. In FIG. 3, the openings are shown purely for convenience near the base of spring members 102*a*, 102*b*. However, it is important to note that not only can any number of openings be provided, but such openings may be provided at any location whatsoever on sheet 100. The location of openings 104 is shown near the base of spring members 102*a*, 102*b* by way of example and to simplify the explanation below regarding how connectivity is provided within the contacts. The spring members 102*a*, 102*b* extend up from a base formed integral with the metallic sheet 100 to a distal end that is configured to have a contact support region, which purely by way of example may be at an apex of a spring member, at what will be a point of contact between the contact that is formed and whatever device is above or below the interposer. In FIG. 4, a cross-sectional view of contact supports 101 is shown.

Figure 5:
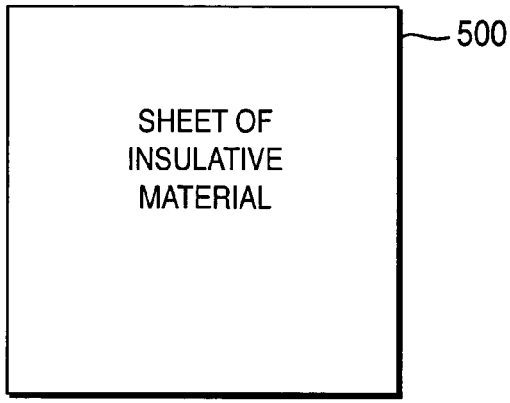
FIG. 5 is a sheet of insulative material in accordance with a preferred embodiment of the present invention.

Referring now to FIG. 5, a sheet 500 of insulative material is shown. The insulative sheet 500 may be made of any type of insulative material, as desired. In a preferred embodiment, the insulative sheet 500 is made of Mylar®. Also, as with the metallic sheet 100, the insulative sheet 500 may be made in any size, shape, and/or thickness, as desired. It is noted, however, that the thinner the insulative sheet 500, the less likely the insulative sheet 500 is to interfere with the spring properties of the spring members 102 of the metallic sheet 100.

Figure 6:
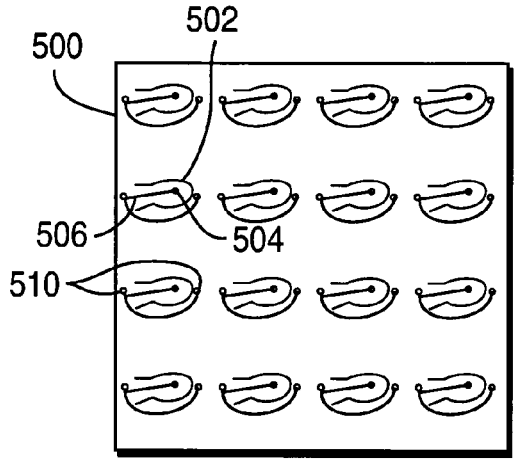
FIG. 6 is a diagram of the sheet shown in FIG. 5 wherein the sheet includes conductive material, preferably in the form of conductive traces, and a plurality of flaps and vias in accordance with an embodiment of the present invention.
Figure 7:
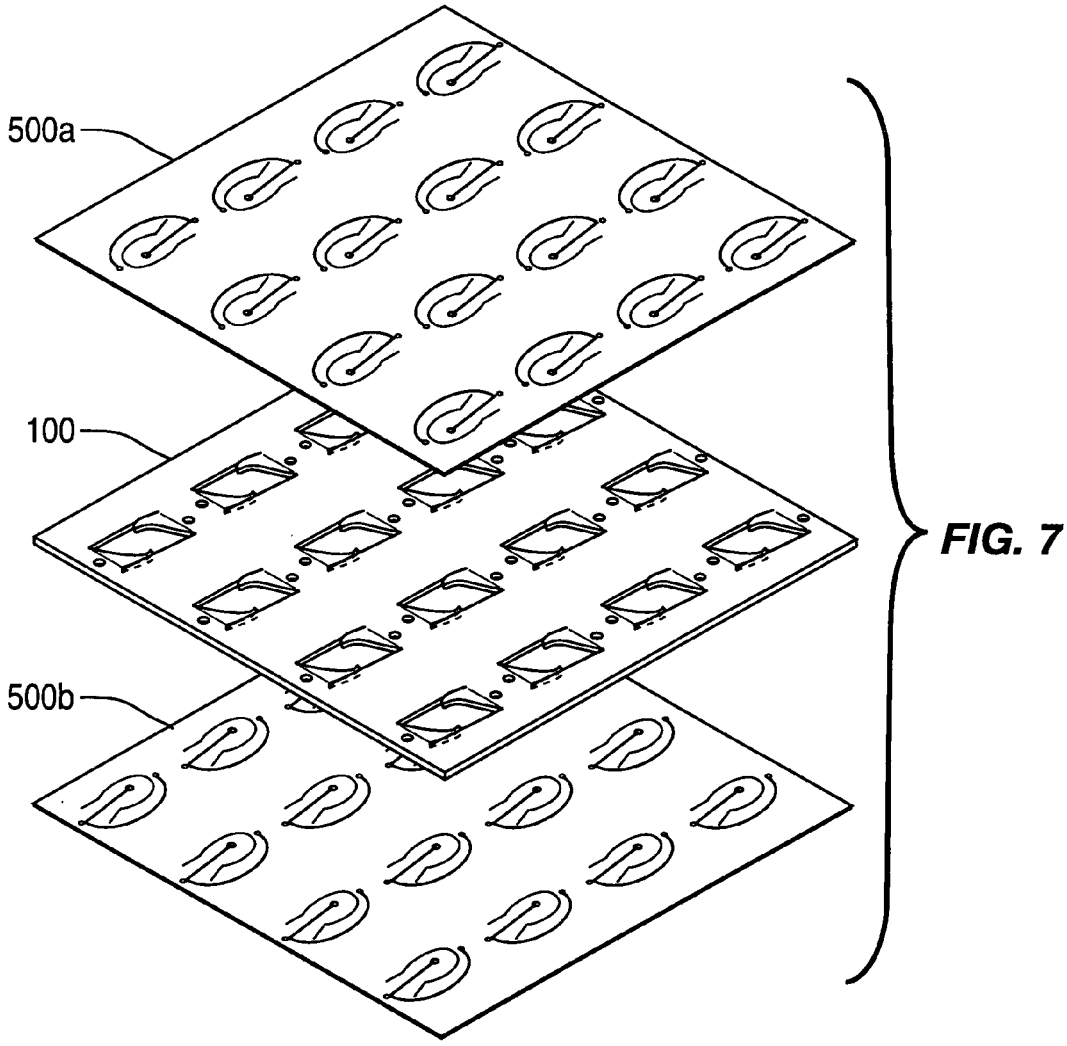
FIG. 7 is a perspective view of insulative sheets being applied to top and bottom surfaces of a metallic sheet.
Figure 8:
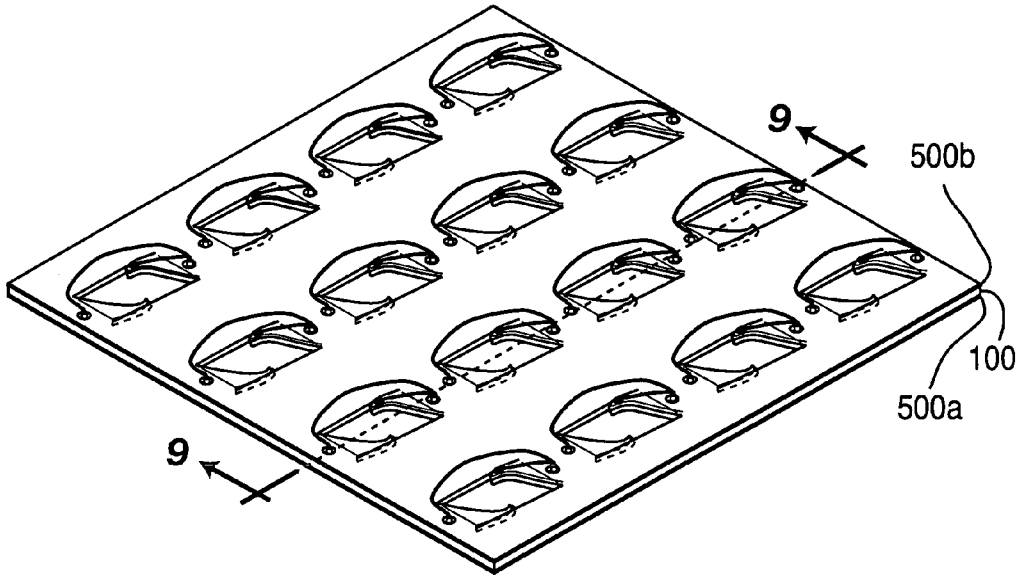
FIG. 8 is a perspective view of the insulative sheets applied to top and bottom surfaces of a metallic sheet.
Figure 10:
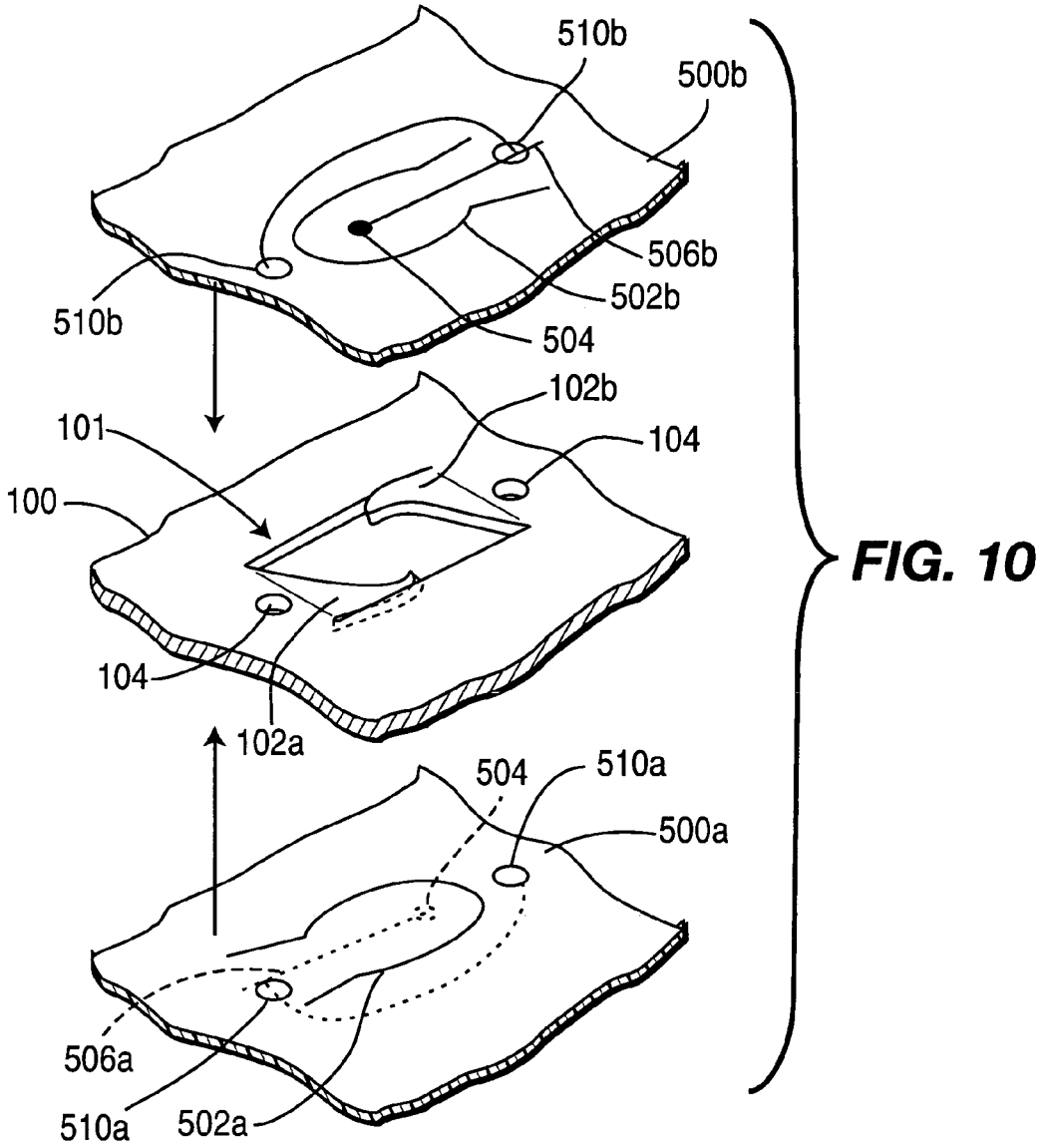
FIG. 10 is an exploded view of a portion of the insulative sheet being applied to top and bottom surfaces of a portion of the metallic sheet.

The insulative sheet 500 is configured with flaps 502 as shown in FIG. 6. In addition to the flaps 502, vias 510 are also defined in sheet 500. The vias 510 preferably correspond to the clearance openings 104 in the metallic sheet 100. In a preferred embodiment, the diameter of the vias 510 is less than the diameter of the clearance openings 104. The flaps 502 and vias 510 may be defined on sheet 500 using any process known to those skilled in the art. Purely by way of example, the flaps 502 and vias 510 may be die cut. It is noted that the shape of the flaps 502 may be any shape. For example, the flaps 502 shown in FIG. 8 are defined to closely correspond to the shape of the spring members 102 whereas the shape of the flaps 502 in FIGS. 6, 7, and 10 are slightly oversized. In one embodiment, the shape may vary as desired, as long as the hinge point of the flap 502 approximately coincides with the base of the flap's 502 corresponding spring member 102, and the location at which conductive material is applied to form a contact area on the flap 502 approximately coincides with a peak of the corresponding spring member 102.

As shown in FIG. 6, conductive material is applied to sheet 500 to form and provide connectivity for each contact. The conductive material, which purely by way of example may be a gold or gold alloy, is preferably applied at a location that approximately corresponds to what will be the contact support region of the contact once the sheet 500 is placed on the metallic sheet 100, as shown in FIGS. 7 and 8. Still referring to FIG. 6, the conductive material at this location forms a contact area 504 in the shape of a dot (hereinafter "dot 504"). The conductive material also preferably extends in the form of a conductive trace 506 from the dot 504 to at least one via 510 in the sheet 500 that approximately corresponds to a clearance opening 104 in the metallic sheet 100. Of course, where there will be more than one electrical connection through the substrates (i.e. the metallic sheet and the insulative sheets), conductive material may be applied on insulative sheet 500 so that it runs from the contact support region to one or more vias 510 provided in the insulative sheet 500. In a preferred embodiment shown in FIGS. 6, 7, and 8, the conductive material is connected from the dot 504 to two vias 510 in the insulative sheet 500.

Referring now to FIGS. 7 and 8 in particular, insulative sheet 500*a*, 500*b* are applied to metallic sheet 100 to create a flexible bond. When the sheets 500*a*, 500*b* are applied to metallic sheet 100, the spring members 102*a*, 102*b* of metallic sheet 100 force the flaps 502 to detach from the insulative sheet 500*a*, 500*b* except at approximately the base of the flap 502 so that the flaps 502 rest atop the spring members 102*a*, 102*b* to which they correspond. The insulative sheet 500*a*, 500*b* may be attached to the metallic sheet 100 in any manner desired. That is, the insulative sheet 500*a*, 500*b* may be fixedly or releasably attached to metallic sheet 100. Purely be way of example, the insulative sheet 500*a*, 500*b* may be laminated or otherwise glued to the metallic sheet 100. By way of further example, the insulative sheet 500*a*, 500*b* may be heated thereby causing a bond with the metallic sheet 100 or it may be applied to the metallic sheet 100 using pressure adhesives or heat adhesives. Alternatively, no adhesives are necessary where the top and bottom sheets are attached to each other at the vias 510 or along their respective perimeter edges.

Figure 9:
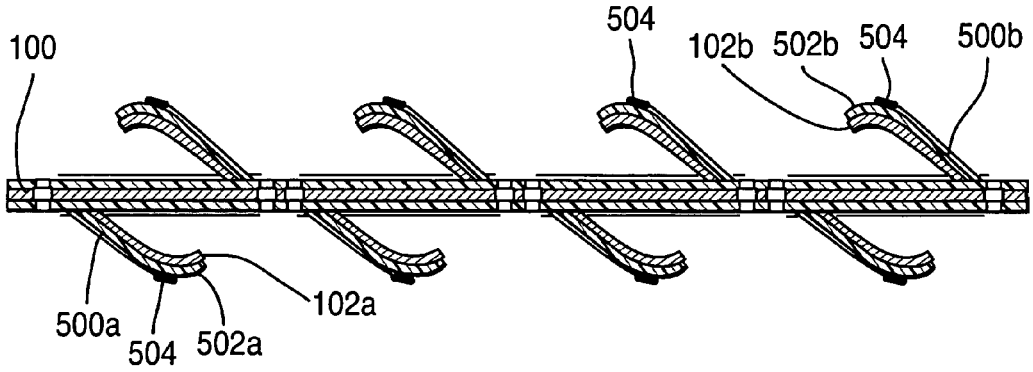
FIG. 9 is cross-sectional view of insulative sheets applied to top and bottom surfaces of a metallic sheet having upward and downward spring members.

Referring now to FIG. 9, a cross-sectional view of a metallic sheet 100 having an insulative sheet 500*a*, 500*b* applied to its bottom and top surface to form the interposer of the present invention is shown. The cross-sectional view is taken along line 9—9 of FIG. 8. When the insulative sheet 500*a*, 500*b* is applied to the metallic sheet 100, the flaps 502*a*, 502*b* of the insulative sheet 500*a*, 500*b* lay on top of spring members 102*a*, 102*b*. The sheet 500*a*, 500*b* is selectively placed such that the conductive material at the point of contact, shown purely for convenience in the form of a dot 504, is placed approximately at the contact support region of its respective spring member. Further, once the sheet 500*a*, 500*b* is in place, the vias 510 in the sheet 500*a*, 500*b* approximately correspond to openings 104 in the metallic sheet 100. The spring members 102*a*, 102*b* are configured to accommodate variations in the surface of devices with which the interposer is in contact, while maintaining electrical connectivity.

Referring now to FIG. 10, an exploded view of a contact support 101 of metallic sheet 100 is shown having an insulative sheet 500*b*, 500*a* being applied to its top and bottom surface to form a contact. As explained above, conductive material is applied to the insulative sheet 500*a*, 500*b* at flap 502*a*, 502*b* in the form of a dot 504 at a point approximately corresponding to the contact support region of the flap's respective spring member. That is, for example, conductive dot 504 on sheet 500*b* approximately corresponds to the contact support region of spring member 102*b* and the conductive dot 504 placed on sheet 500*a* approximately corresponds to the contact support region of spring member 102*a*. As previously explained, a trace of the conductive material 506*a*, 506*b* is also run from the respective dot 504 to at least one via 510*a*, 510*b*. Of course, in the embodiment shown in FIG. 10 the conductive material is run to two vias.

Figure 11:
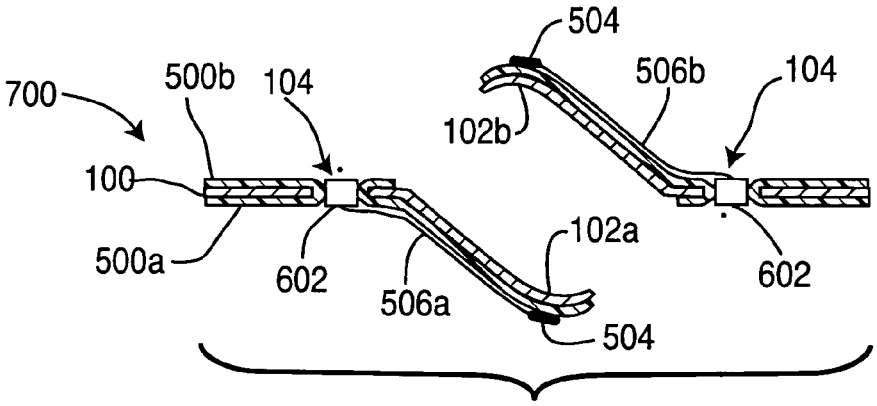
FIG. 11 is an enlarged cross-sectional view of a contact of an interposer including a metallic sheet having an insulative sheet on its top and bottom surface.

Referring now to FIG. 11, a contact 700 formed in accordance with the first preferred embodiment is shown. It is important to note that when the sheets 500*a*, 500*b* are applied to the metallic sheet 100, the sheets 500*a*, 500*b* are pinched at the openings 104 so that electricity running through the contact 700 is insulated from the metallic sheet 100. To insulate openings 104, by way of example, the sheets 500*a*, 500*b* may be heat sealed or attached with an adhesive. Alternatively, openings 104 may be coated with an insulative material prior to through-plating (described below) or an insulative material may be applied subsequent to applying the insulative sheets 500*a*, 500*b* to metallic sheet 100. Additionally, in another embodiment, a coating or layer of an insulative oxide may be applied to the metallic sheet 100 so that it does not become electrically conductive. Application of an insulative oxide to the metallic sheet 100 may also help the adhesion of the insulative material to the metallic sheet 100.

Once the openings 104 are insulated, a conductive material 602 is plated-through each via 510 and its corresponding clearance opening 104 so that an electrical connection is made with the respective trace 506*a*, 506*b*. Once the conductive material 602 is plated-through and an electrical connection is made, the opening 104 may be referred to as a conductive via. It is important to note that the conductive material utilized in the present invention may be any type of conductive material, as desired. In a preferred embodiment, the conductive material is a gold or gold alloy.

Figure 12:
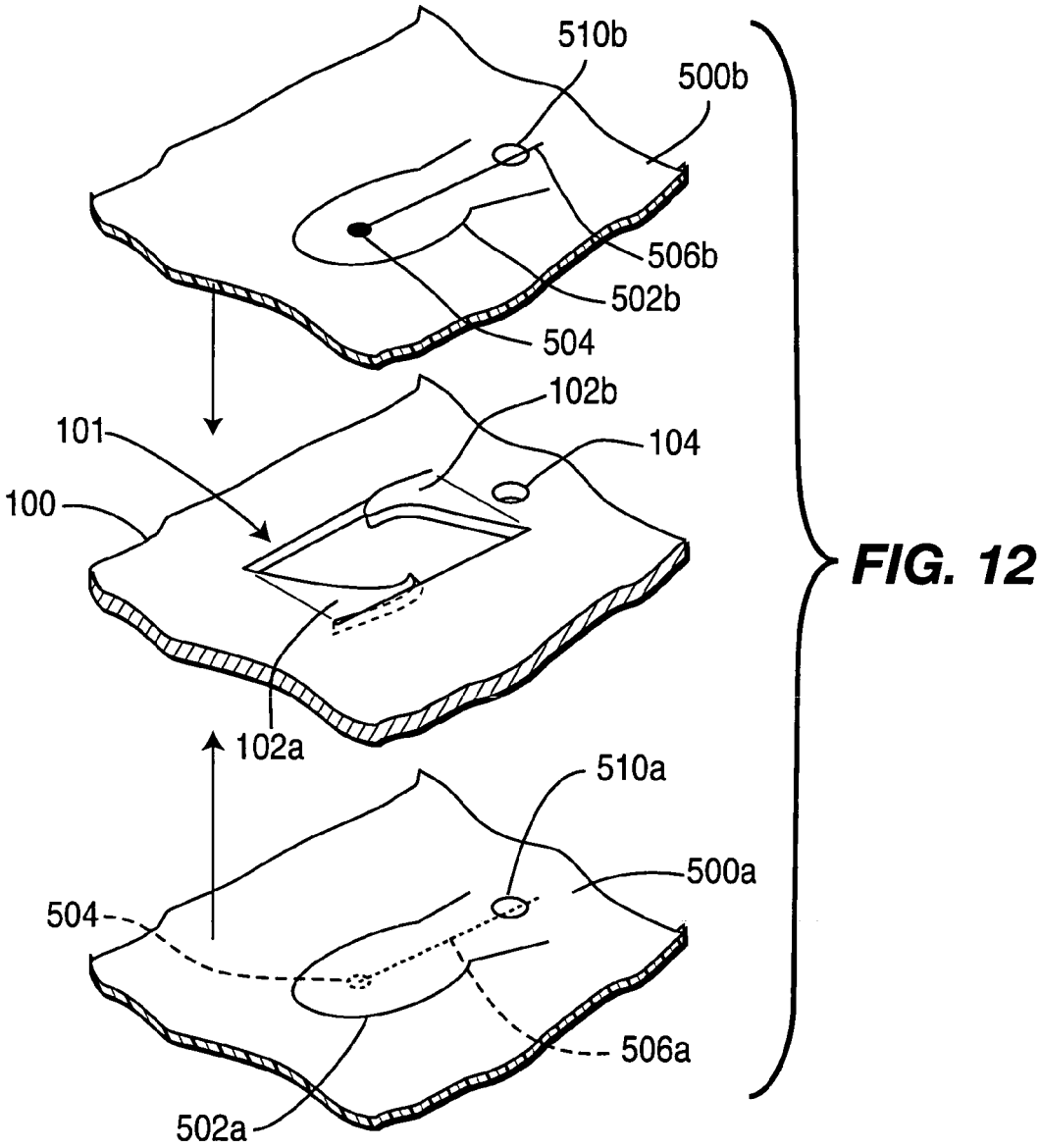
FIG. 12 is an exploded view of a portion of the insulative sheet being applied to top and bottom surfaces of a portion of the metallic sheet wherein a single plated-through via is provided at each contact.
Figure 13:
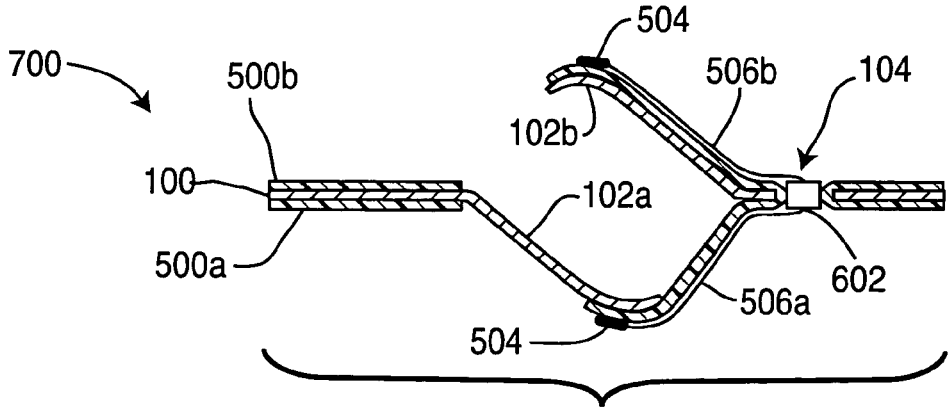
FIG. 13 is an enlarged cross-sectional view of a contact of an interposer including a metallic sheet having an insulative sheet on its top and bottom surface wherein a single plated-through via is provided at each contact.

Referring now to FIGS. 12 and 13, a second preferred embodiment of the present invention is shown wherein a single plated-through via is provided at each contact 700. In this embodiment, insulative sheet 500*a* is applied to the metallic sheet 100 in the same direction that insulative sheet 500*b* is. A single clearance opening 104 is provided in metallic sheet 100 and a single via 510*a*, 510*b* is provided in insulative sheets 500*a*, 500*b*. At insulative sheet 500*a*, a conductive trace 506*a* is applied from dot 504 to via 510*a*. Similarly, at insulative sheet 500*b*, a conductive trace 506*b* is applied from dot 504 to via 510*b*.

Applying the bottom sheet 500*a* in the same direction as sheet 500*b*, as shown in FIG. 12, results in the contact 700 being formed as shown in FIG. 13. In FIG. 13, electrical connectivity is provided at contact 700 from top dot 504 through trace 506*b*, conductive material 602, trace 506*a*, to bottom dot 504. Of course, electrical connectivity is also provided from bottom dot 504, through trace 506*a*, conductive material 602, trace 506*b*, to top dot 504. This preferred embodiment provides a direct route for providing electrical connectivity between the top and bottom dots 504.

Figure 14:
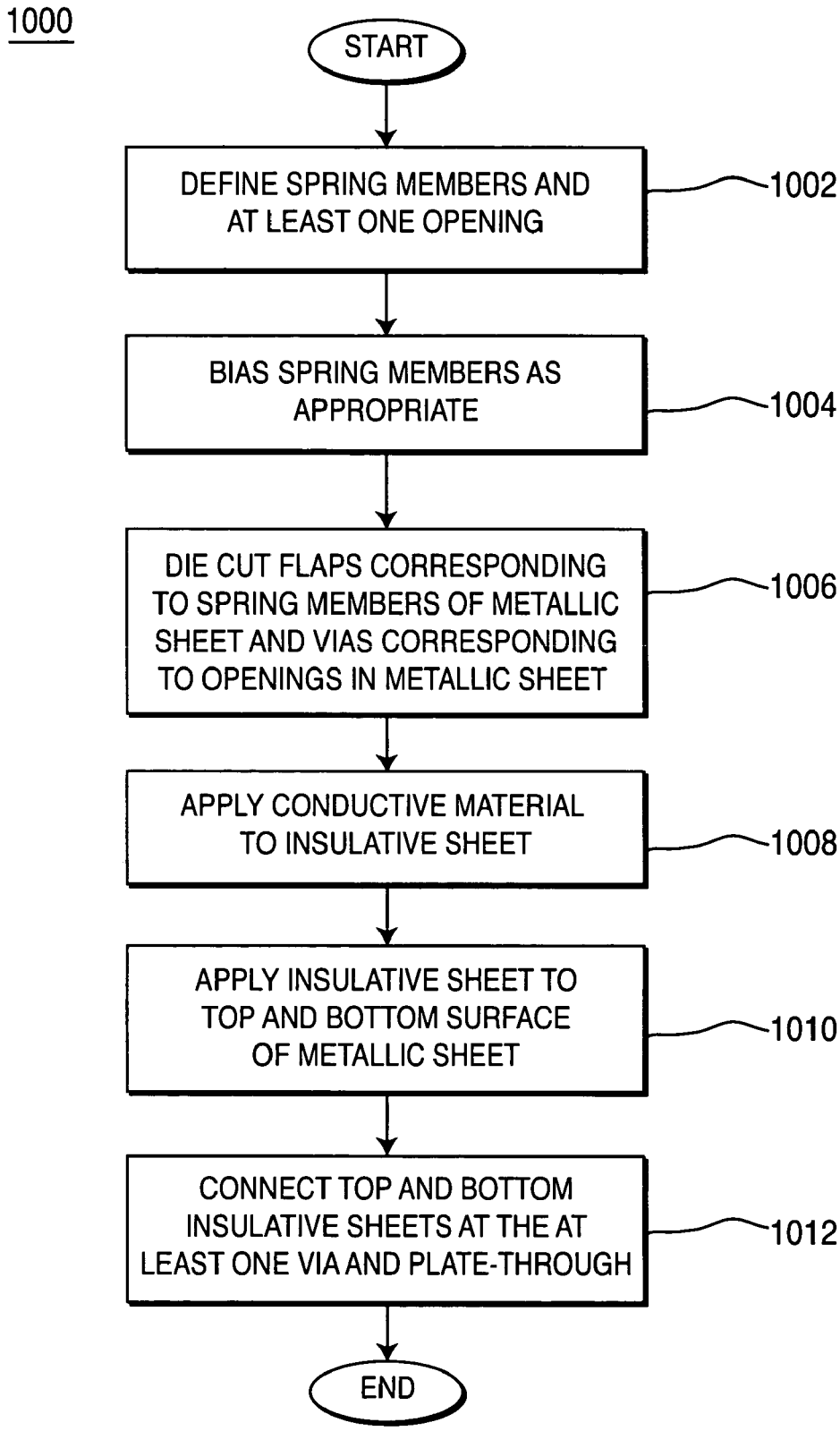
FIG. 14 is a flowchart showing steps of a method for making an interposer in accordance with a preferred embodiment of the present invention.

Referring now to FIG. 14, a method 1000 is shown for making an interposer in accordance with the present invention. The method 1000 begins in step 1002 with defining contact supports having at least two spring members and defining at least one clearance opening in a metallic sheet. Next, in step 1004, at each contact support in a metallic sheet, at least one spring member is biased upwardly and at least one spring is biased downwardly to form upward and downward biased spring members. As mentioned above, the spring members may be formed so that they are biased in a particular direction by applying pressure to the member in the desired direction.

Moving to step 1006, flaps and vias are die cut or otherwise defined in a sheet of insulative material. The flaps of the insulative sheet preferably approximately correspond in shape and location to spring members in the metallic sheet. The vias of the insulative sheet preferably approximately correspond to openings in the metallic sheet. Then, in step 1008, conductive material is added to the insulative sheet so that the conductive material is configured to provide a contact point at locations of the insulative sheet that approximately correspond to the contact support region of spring members of a metallic sheet on which the insulative sheet will be applied. As explained above, the conductive material preferably runs from the contact point to at least one via in the insulative sheet that approximately corresponds to an opening in a metallic sheet. It is important to note that step 1008 may be performed prior to step 1006.

In step 1010, the insulative sheet is applied to the top and bottom surface of the metallic sheet to form the interposer of the present invention. Next, in step 1012, the top and bottom sheets are connected at the least one via and the via is plated-through with a conductive material. This completes the circuit(s) between the at least two points of contact for each contact provided in the interposer.

It is noted that when performing method 1000, the steps may be performed in any order as desired. That is, the particular ordering of the steps shown in FIG. 14 is for convenience in explaining the present invention. For example, application of conductive material to the insulative sheet may be performed subsequent to applying the insulative sheet to the metallic sheet and plating-through the via(s). Furthermore steps related to defining elements of the metallic and insulative sheets may of course be performed at any time with respect to each other including the simultaneous performance thereof.

Although the features and elements of the present invention are described in the preferred embodiments in particular combinations, each feature or element can be used alone (without the other features and elements of the preferred embodiments) or in various combinations with or without other features and elements of the present invention.

What is claimed is:

1. An interposer for providing electrical connectivity between two devices, the interposer comprising:

a sheet of metallic material having a plurality of contact supports, each contact support including at least one spring member;

a first sheet of insulative material disposed on a top surface of the sheet of metallic material and a second sheet of insulative material disposed on a bottom surface of the sheet of metallic material;

the first sheet of insulative material having flaps at least partially corresponding to spring members of the metallic sheet;

a conductive material provided on the first sheet of insulative material at a location approximately corresponding to a contact support region of the spring member to form a first contact area; and a trace of conductive material provided on the first sheet of insulative material extending from the contact area to a conductive via extending from an outwardly directed surface of the first sheet of insulative material to an outwardly directed surface of the second sheet.

2. An interposer for providing electrical connectivity between two devices, the interposer comprising:

a sheet of metallic material having a plurality of contact supports, each contact support including at least two spring members, a first one of the two spring members being disposed upwardly and a second of the spring members being disposed downwardly;

a first sheet of insulative material disposed on a top surface of the sheet of metallic material and a second sheet of insulative material disposed on a bottom surface of the sheet of metallic material;

the first sheet of insulative material having flaps at least partially corresponding to spring members of the metallic sheet;

a conductive material provided on the first sheet of insulative material at a location approximately corresponding to a contact support region of the upwardly disposed spring member to form a first contact area; and a trace of conductive material provided on the first sheet of insulative material extending from the contact area to a conductive via extending from an outwardly directed surface of the first sheet of insulative material to an outwardly directed surface of the second sheet.

3. An interposer for providing electrical connectivity between two devices, the interposer comprising:

a sheet of metallic material having a plurality of contact supports, each contact support including at least one spring member;

a first sheet of insulative material disposed on a top surface of the sheet of metallic material and a second sheet of insulative material disposed on a bottom surface of the sheet of metallic material;

the first sheet of insulative material having flaps at least partially corresponding to spring members of the metallic sheet;

a conductive material provided on the first sheet of insulative material at a location approximately corresponding to a contact support region of the spring member to form a first contact area; and a trace of conductive material provided on the first sheet of insulative material extending from the contact area to at least two conductive vias extending from an outwardly directed surface of the first sheet of insulative material to an outwardly directed surface of the second sheet.

4. An interposer for providing electrical connectivity between two devices, the interposer comprising:

a sheet of stainless steel having a plurality of contact supports, each contact support including at least one spring member;

a first sheet of insulative material disposed on a top surface of the stainless steel sheet and a second sheet of insulative material disposed on a bottom surface of the stainless steel sheet;

the first sheet of insulative material having flaps at least partially corresponding to spring members of the stainless steel sheet;

a conductive material provided on the first sheet of insulative material at a location approximately corresponding to a contact support region of the spring member to form a first contact area; and a trace of conductive material provided on the first sheet of insulative material extending from the contact area to a conductive via extending from an outwardly directed surface of the first sheet of insulative material to an outwardly directed surface of the second sheet.

5. An interposer for providing electrical connectivity between two devices, the interposer comprising:

a sheet of metallic material having a plurality of contact supports, each contact support including at least one spring member;

a first sheet of insulative material disposed on a top surface of the sheet of metallic material and a second sheet of insulative material disposed on a bottom surface of the sheet of metallic material;

the first sheet of insulative material having flaps at least partially corresponding to spring members of the metallic sheet;

a conductive material provided on the first sheet of insulative material at a location approximately corresponding to a contact support region of the spring member to form a first contact area; and a trace of conductive material provided on the first sheet of insulative material extending from the contact area to a conductive via extending from an outwardly directed surface of the first sheet of insulative material to an outwardly directed surface of the second sheet and being plated-through with a conductive material.

6. An interposer for providing electrical connectivity between two devices, the interposer comprising:

a sheet of metallic material having a plurality of contact supports, each contact support including at least one spring member;

a first sheet of insulative material disposed on a top surface of the sheet of metallic material and a second sheet of insulative material disposed on a bottom surface of the sheet of metallic material;

the first sheet of insulative material having flaps at least partially corresponding to spring members of the metallic sheet;

a conductive material provided on the first sheet of insulative material at a location approximately corresponding to a contact support region of the spring member to form a first contact area;

a trace of conductive material provided on the first sheet of insulative material extending from the contact area to a conductive via extending from an outwardly directed surface of the first sheet of insulative material to an outwardly directed surface of the second sheet; and the insulative material being configured to electrically insulate the conductive material from the metallic material.

7. An interposer for providing electrical connectivity between two devices, the interposer comprising:

a sheet of metallic material coated with an insulative oxide and having a plurality of contact supports, each contact support including at least one spring member;

a first sheet of insulative material disposed on a top surface of the sheet of metallic material and a second sheet of insulative material disposed on a bottom surface of the sheet of metallic material;

the first sheet of insulative material having flaps at least partially corresponding to spring members of the metallic sheet;

a conductive material provided on the first sheet of insulative material at a location approximately corresponding to a contact support region of the spring member to form a first contact area; and a trace of conductive material provided on the first sheet of insulative material extending from the contact area to a conductive via extending from an outwardly directed surface of the first sheet of insulative material to an outwardly directed surface of the second sheet.

* * * * *

UNITED STATES PATENT AND TRADEMARK OFFICE

CERTIFICATE OF CORRECTION

PATENT NO. : 7,025,601 B2
APPLICATION NO. : 10/884709
DATED : April 11, 2006
INVENTOR(S) : Dittmann It is certified that error appears in the above-identified patent and that said Letters Patent is hereby corrected as shown below:

On Sheet 6 of 6, in Fig. 14 (Box 1012), line 3, delete "PLATE-THROUGH" and insert -- PLATED-THROUGH --, therefor.

Signed and Sealed this

Nineteenth Day of June, 2007

JON W. DUDAS
*Director of the United States Patent and Trademark Office*